US011448038B2

(12) United States Patent
Cao et al.

(10) Patent No.: US 11,448,038 B2
(45) Date of Patent: Sep. 20, 2022

(54) REVERSE CEMENTING VALVE SYSTEM AND METHOD EMPLOYING A DOUBLE FLAPPER VALVE WITH SLIDING SLEEVE AND DRILLABLE NOSE

(71) Applicant: HALLIBURTON ENERGY SERVICES, INC., Houston, TX (US)

(72) Inventors: Jinhua Cao, Houston, TX (US); Michael Linley Fripp, Carrollton, TX (US); Tor Sigve Saetre, Houston, TX (US); Lonnie Carl Helms, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 39 days.

(21) Appl. No.: 16/953,186

(22) Filed: Nov. 19, 2020

(65) Prior Publication Data

US 2021/0246759 A1 Aug. 12, 2021

Related U.S. Application Data

(60) Provisional application No. 62/975,534, filed on Feb. 12, 2020.

(51) Int. Cl.

| | |
|---|---|
| ***E21B 33/14*** | (2006.01) |
| ***E21B 34/08*** | (2006.01) |
| ***E21B 34/14*** | (2006.01) |

(52) U.S. Cl.

CPC ..... *E21B 33/14* (2013.01); *E21B 34/08* (2013.01); *E21B 34/142* (2020.05); *E21B 2200/05* (2020.05); *E21B 2200/06* (2020.05)

(58) Field of Classification Search

CPC ..... E21B 33/14; E21B 34/08; E21B 34/142; E21B 2200/05; E21B 2200/06; E21B 17/14; E21B 21/10

See application file for complete search history.

(56) References Cited

U.S. PATENT DOCUMENTS 5,494,107 A * 2/1996 Bode ..... E21B 33/14 166/323

6,679,336 B2 1/2004 Musselwhite et al.

(Continued)

FOREIGN PATENT DOCUMENTS

| | | |
|---|---|---|
| CN | 201050341 Y | 4/2008 |
| KR | 200454518 Y1 | 7/2011 |

OTHER PUBLICATIONS

International Search Report and Written Opinion, PCT Application No. PCT/US2020/062708, dated Mar. 24, 2021.

(Continued)

*Primary Examiner* — Michael R Wills, III

(74) *Attorney, Agent, or Firm* — Novak Druce Carroll LLP

(57) ABSTRACT

A reverse cementing apparatus having a reverse cementing body with an internal bore, the reverse cementing body being coupleable to the downhole end of a casing pipe. The apparatus may further have a valve actuable from a closed to an open configuration, the closed configuration obstructing flow of fluid through the internal bore of the reverse cementing body. The valve may be configured to obstruct flow in an uphole direction during deployment but permit flow in the downhole direction. The apparatus further includes a port provided extending through a wall of the reverse cementing valve body from the internal bore to external the reverse cementing body, a fluid communication channel extending from the port to the internal bore. An actuable barrier member may be provided which is actuable to a closed position obstructing flow of fluid through the port upon actuation.

21 Claims, 6 Drawing Sheets

(56) References Cited

U.S. PATENT DOCUMENTS

| | | | | |
|---|---|---|---|---|
| 7,322,412 | B2 * | 1/2008 | Badalamenti | E21B 21/10 166/386 |
| 8,955,543 | B2 * | 2/2015 | Groesbeck | E21B 34/16 137/515 |
| 10,208,567 | B2 * | 2/2019 | Recchioni | E21B 34/14 |
| 10,619,448 | B1 * | 4/2020 | Watson | E21B 34/063 |
| 2004/0060697 | A1 | 4/2004 | Tilton et al. | |
| 2007/0062700 | A1 * | 3/2007 | Webb | E21B 33/14 166/325 |
| 2008/0196889 | A1 | 8/2008 | Bour et al. | |
| 2016/0102523 | A1 * | 4/2016 | Sponchia | E21B 34/14 166/250.14 |
| 2017/0370186 | A1 * | 12/2017 | Stair | E21B 34/063 |
| 2018/0112493 | A1 * | 4/2018 | Recchioni | E21B 34/12 |

OTHER PUBLICATIONS

English Abstract of CN 201050341Y; Retrieved from www.espacenet.com on Apr. 21, 2021.

English Abstract of KR 20-0454518Y1; Retrieved from www.espacenet.com on Apr. 21, 2021.

* cited by examiner

REVERSE CEMENTING VALVE SYSTEM AND METHOD EMPLOYING A DOUBLE FLAPPER VALVE WITH SLIDING SLEEVE AND DRILLABLE NOSE

CROSS-REFERENCE TO RELATED APPLICATIONS

This application claims the benefit of U.S. Provisional Application No. 62/975,534, filed on Feb. 12, 2020, the disclosure of which is hereby incorporated by reference in its entirety.

FIELD

The present disclosure relates generally to an apparatus and a method for a reverse cementing valve that includes a double flapper valve, a sliding sleeve and a drillable nose.

BACKGROUND

Wellbores are formed by drilling deep into subterranean formations in order to withdraw hydrocarbons. Typically, after drilling, the wellbore is then lined with a steel casing to maintain the shape of the wellbore and to prevent the loss of fluids to the surrounding environment. The steel casing is often bonded to the surface of the wellbore by cement or other sealant. Cementing operations are carried out to inject cement into the annulus between the casing and the wellbore.

The cementing operations can include pumping cement through the bore of the casing, out of the bottom of the casing and up through the annulus between the surface of the wellbore and the external surface of the casing. Other cementing operations include reverse cementing, where cement is pumped from the surface through the annulus of the wellbore, into the bore of the casing, and up toward the surface.

Fiber optic sensing systems have been employed in wellbores for the detection of various properties, including temperature, strain, vibration, acoustics and pressure. In such fiber optic systems, light is often transmitted from the surface through the fiber optic cables and backscattered and/or reflected light is eventually received by a detector. Upon experiencing changes in the light during its transmission, the corresponding changes can be used to determine downhole properties.

BRIEF DESCRIPTION OF THE DRAWINGS

Implementations of the present technology will now be described, by way of example only, with reference to the attached figures, wherein.

DETAILED DESCRIPTION

Figure 1:
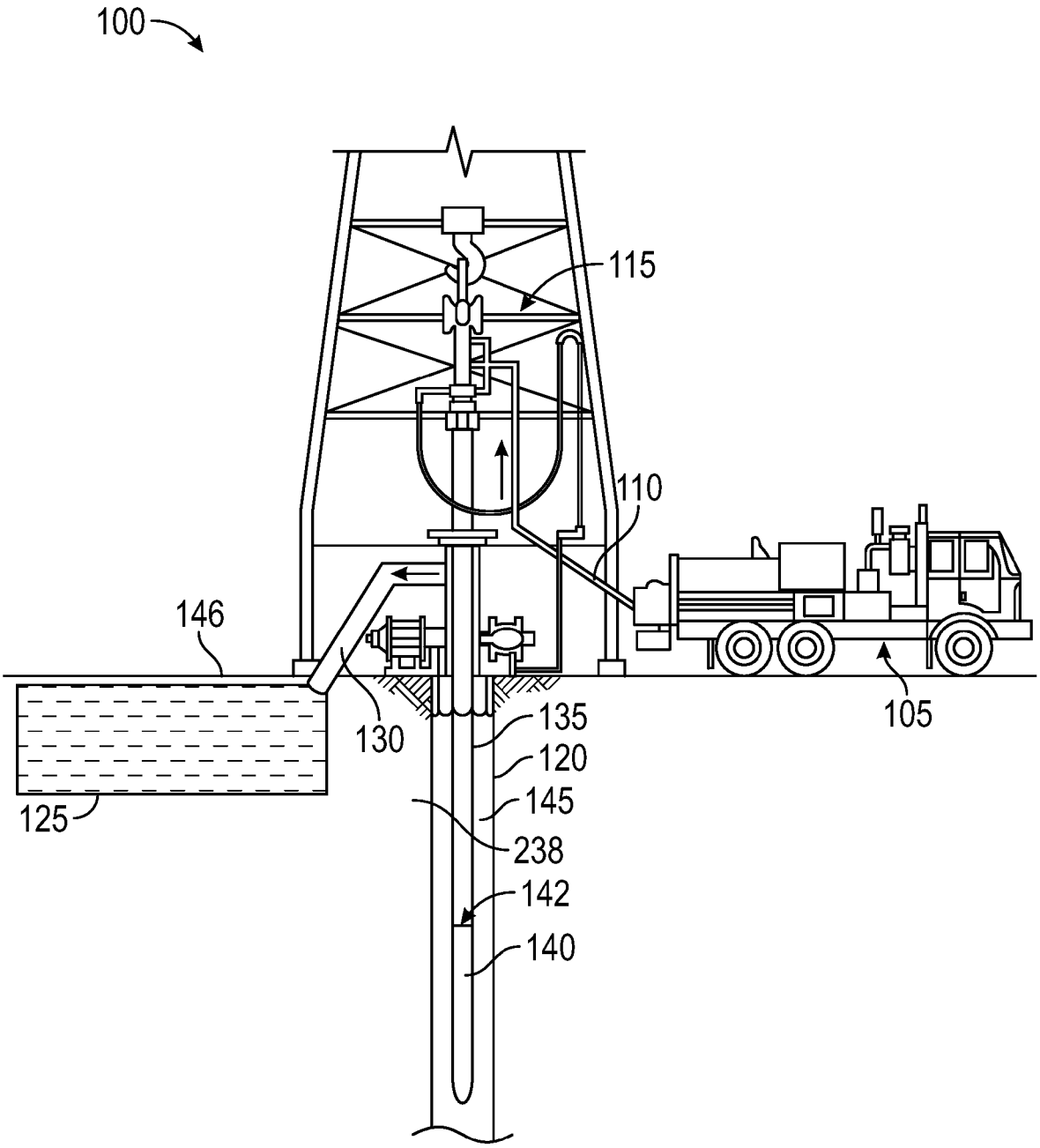
FIG. 1 shows an exemplary wellbore environment in which the present disclosure may be implemented.

Various embodiments of the disclosure are discussed in detail below. While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, it may not be included or may be combined with other features.

Introduction and Overview

Traditional cementing operations involve displacing fluids (spacers/flushes/slurries) down through the bore of the casing and out the shoe on the bottom of the casing string. From that point, the cement is lifted into the annular space between the outside of the casing and the wellbore (formation wall) to the desired level referred to as the top of cement. The desired goal is for the cement to completely fill this space and achieve a hydraulic seal for successful zonal isolation. Conversely, in reverse circulation cementing operations, cementing fluids are placed down through the annulus and into the shoe at the bottom of the casing. Lower hydraulic horsepower is needed for reverse circulation cementing and the operation requires less rig time than with traditional cementing operations.

Reverse circulation cementing operations rely on gravity forces and density differences to aid in the fluid-flow process. Backpressure may be required to control the slurry free fall and placement time is shortened. Because only the lead portion of the cement is exposed to bottomhole temperatures, the thickening time can be customized and the amount of retarder can be staged and/or reduced resulting in a relatively faster set time. This helps control fluid migration and plastic formation movement, reducing the potential for production zone invasion of the slurry during placement.

Among others, reverse circulation cementing is a particularly advantageous option include the following situations: (1) Cementing past weak formation that can tolerate only very low equivalent circulating densities; (2) When up-hole porosity or water table is present requiring rapid compressive strength development; (3) When the probability of seepage loss from the cement system could create blockage in the producing zone; (4) Placing large slurry volumes with long displacement times and wide temperature differentials;

and (5) Temperature restrictions such as deep high-temperature zones or shallow low-temperature zones. While reverse circulation cementing may be employed in these particular situations, it may be utilized in other situations as well.

Standard float equipment is generally not used for reverse circulation cementing operations, and additional well conditioning as well as larger spacer and shoe track volumes may be required. The surface operations require different iron configuration as compared to conventional cementing. Specific tools and/or methodologies may be implemented for estimating the top of cement, including use of an indicator to determine when cement is entering the casing or pipe. The cement within the casing may need to be drilled out after operations.

When using cementing equipment, there exists a challenge of closing the flow path from the annulus into the interior of the casing (also referred to as the Interior Diameter or ID of the casing) at the end of a reverse cementing operation.

Disclosed herein is a reverse cementing apparatus which facilitates control of the flow of fluids and cement during a reverse cementing process. In particular, the reverse cementing apparatus permits control of the flow of the fluids through the casing during insertion into the wellbore. The apparatus also facilitates the flow of a cement slurry into the annulus and up through the casing during reverse cementing, as well as enables the cessation of the flow of cement into the apparatus at the end of a reverse cementing job. The reverse cementing apparatus also includes a drillable end nose to facilitate a drill out stage. Moreover, the control may be further enhanced by the use of fiber optic cables.

The reverse cementing apparatus may include a valve in the internal bore of the apparatus, a port through the walls of the body, and an actuable barrier to obstruct flow through the port into the apparatus at the end of the cementing process and/or at a predetermined time. During a cementing job, the reverse cementing apparatus may be coupled with a downhole end of a casing being inserted into a wellbore. This insertion process of the casing may be referred to a Run-in-Hole (RIH).

During the RIH the valve in the internal bore of the reverse cementing apparatus may be held in a closed configuration. However, during the RIH insertion, it may be required or desired to pump fluids downhole through the internal bore and out of the port. Accordingly, the valve may be closed or otherwise block or obstruct the flow of fluids flowing in the uphole direction (from the downhole end of the apparatus toward the uphole end) while permitting flow in the downhole direction (from the uphole end of the apparatus toward the downhole end). Exemplary valves which may be employed include a check valve, flapper valve, and/or a dual flapper valve. Accordingly, during RIH, such valves would prevent flow uphole, while permitting fluid to be pumped from the surface through the valve downhole and out the port of the apparatus.

Furthermore, once RIH is complete and the reverse cementing apparatus is in a predetermined position downhole, a reverse cementing operation can be conducted. Prior to, or during, the reverse cementing operation, the valve in the internal bore is actuated from a closed to an open configuration. A dart, such as a ball, may be dropped from the surface, which upon engaging surfaces of a projection or the reverse cementing apparatus cause the valve to prop the valve in the open configuration. This may be carried out for example by inserting an object such as a stinger or other mechanical object through the valve to prop it open. For example, the dart may contact surfaces of a stinger and urge the stinger against the valve to maintain the valve in the open configuration. The stinger or other projection may be retained in place until actuated.

The reverse cementing apparatus also has a port which extends through a wall of the body of the reverse cementing apparatus. The port creates a fluid communication channel from the port to the internal bore. Accordingly, during reverse cementing, the cement slurry is pumped from the surface through the annulus between the surface of the wellbore (wall of the formation) and the casing and up through the port into the internal bore of the reverse cementing apparatus and to the casing.

When reverse cementing is complete, the port may be closed by actuating a barrier to obstruct flow of cement slurry through the port. This closes the flow path between the annulus and interior of the reverse cementing apparatus and the casing. This barrier may for example be a sliding sleeve, or a pivotable arm. In addition, the reverse cementing apparatus has a nose portion that closes the bottom end of the casing pipe and which is constructed of drillable or dissolvable material. The shape of the nose can be of any guide nose shape, such as round, taper or offset taper that facilitates insertion.

Accordingly, the reverse cementing apparatus, system and method disclosed herein facilitates four states. A first Run-in-Hole (RIH) stage where the reverse cementing apparatus is inserted downhole at the end of casing string. During this stage, the valve in the internal bore only permits fluid to pass in the downhole direction but blocks fluid from passing through in the uphold direction. A second reverse circulation and cementing stage, where once the reverse cementing apparatus is placed in the desired position in the wellbore, the valve is actuated to be propped open. A cement slurry is then pumped from the surface, down through the annulus, through the port of the reverse cementing apparatus and up through the internal bore passed past the opened valve. A third end-of-job stage, where a barrier is actuated to close or otherwise obstruct flow through the port. A fourth drill-out stage where the valve, end nose, and any other component in the path of the internal bore is drilled out.

The present disclosure provides one or more of the following: (1) an actuable barrier for selectively closing the cement flow ports from the annulus into the interior of the casing pipe after the cement has filled the annulus; (2) construction materials that are drillable or degradable, including dissolvable, after the reverse cementing job is completed; and (3) a valve, such as a double flapper valve, that provides well control during RIH to prevent possible downhole pressure kicks and the like, and which can be opened to permit cement flow during the reverse cementing procedure.

Reverse Cementing Apparatus

FIG. 1 illustrates an exemplary downhole environment 100 in which the present disclosure may be implemented. The cement unit 105, which may be a truck as shown, may include mixing equipment and pumping equipment. The cement unit 105 may pump a cement slurry through a feed pipe 110 and to a cement head 115 which conveys the cement, or other fluid, downhole, for example into the wellbore 120. A retention pit 125 may be provided in into which displaced fluids from the wellbore 120 may flow via line 130 (e.g., a mud pit).

As shown a casing 135 may be inserted from the surface 146 of the earth in to the wellbore 120. The casing 135 may be a plurality of individual tube, or joints, and has a reverse cementing apparatus 140 on the downhole end 142 thereof, the uphole end being toward the surface 146. During a Run-In-Hole stage, the casing 135 is inserted into the wellbore 120. During this stage, fluid may be pumped through the casing 135 in a downhole direction toward the end of the wellbore 120. Once the reverse cementing apparatus 140 is positioned in the desired location in the wellbore 120 then reverse cementing operations may be started.

Figure 2:
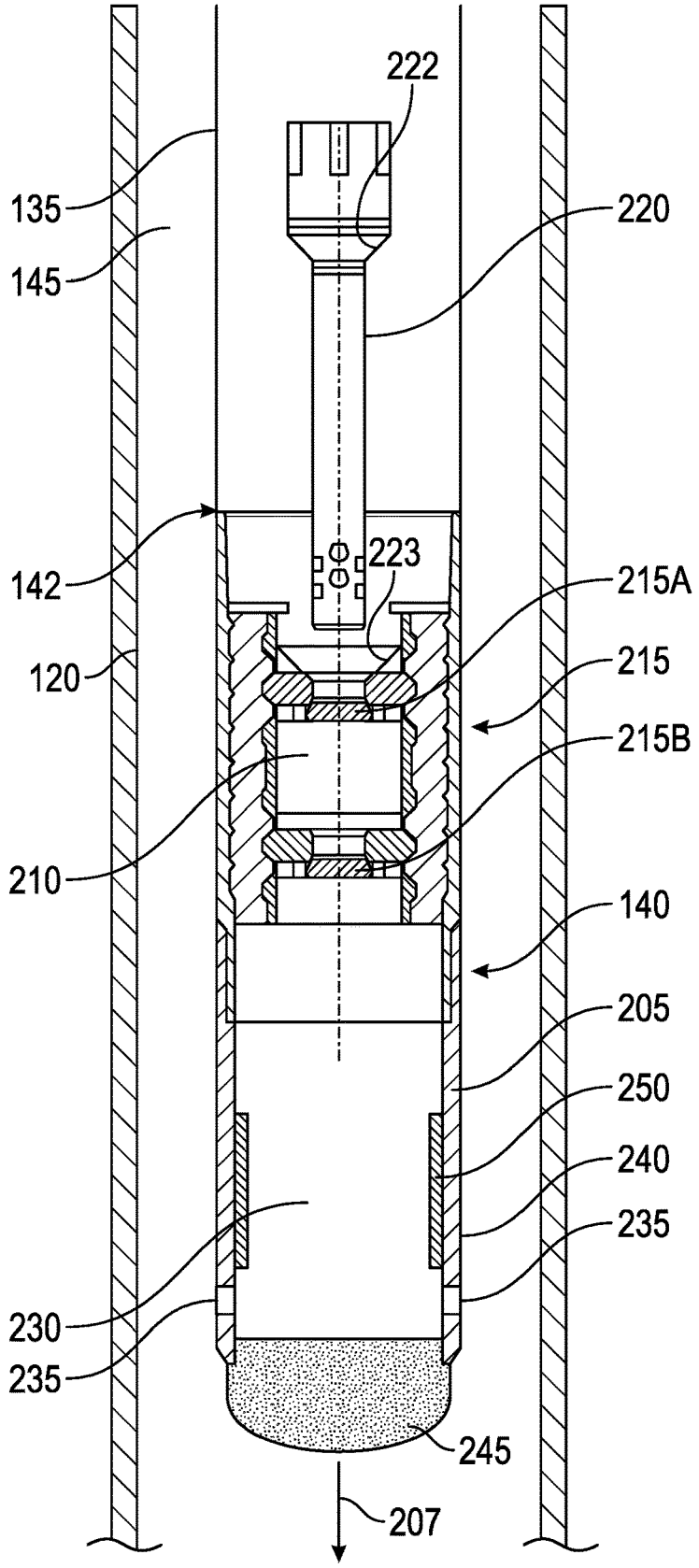
FIG. 2 illustrates a reverse cementing apparatus for a Run-in-Hole ("RIH") operation according to the present disclosure.

FIG. 2 illustrates a reverse cementing apparatus 140 during a run-in-hole operation. In FIG. 2, the top of the Figure is the uphole direction, and the bottom of the figure is the downhole direction. As shown the reverse cementing apparatus 140 is being inserted downhole as represented by the directional arrow 207. The reverse cementing apparatus 140 is coupled to a casing 135 the casing's downhole end 142. The reverse cementing apparatus 140 has a body 205 with an internal bore 210. The internal bore 210 includes a valve 215, which as shown is a dual flapper valve, having an upper flapper valve 215A and a lower flapper valve 215B. The valve 215 is closed and prevents fluid flow in an uphole direction. However, the valve 215 may be moved to an open configuration by fluid flow in the downhole direction, the same direction indicated by directional arrow 207. When the fluid flow has sufficient pressure, the dual flapper is forced to the open configuration by pivoting in the downhole direction. Although a dual flapper valve is shown in the embodiment of FIG. 2, any valve may be employed which has the same or similar effect, including a single flapper valve and/or a check valve.

The reverse cementing apparatus 140 has a stinger 220 which may be retained just above the valve 215 in the uphole direction. The stinger 220 may be held for example by a shear pin (not shown), or other device which holds the stinger 220 in a fixed position until reaching a predetermined force. The position of stinger 220 in FIG. 2 is the disengaged configuration. The stinger 220 is positioned proximate the valve 215 and transitional between a disengaged configuration away from flappers of the dual flapper valve (shown in FIG. 2) and an actuated configuration in which the stinger is positioned to block open the flappers in the open configuration (open configuration shown in FIG. 3).

A chamber 230 is provided in the lower portion of the body 205 which is part of the internal bore 210. A port 235 is provided along the lower portion of the body 205, which extending through a wall 240 of the body 205 extending from the chamber 230 to external (outside) the body 205, such as the annulus 145. The port 235 is in fluid communication with the chamber 230 and the internal bore 210. Furthermore, an end nose 245 is provided at the downhole end of the body 205. The end nose 245 may be made up of a drillable material to facilitate drill-out at the end of a reverse cementing operation. The port 235 may be a plurality of ports or a singular port.

An actuable barrier 250 is provided which may be actuated to obstruct the port 235. The actual barrier 250 is shown as a sliding sleeve in FIG. 2. The actuable barrier 250 may be shifted by electrical connection to the surface, a battery or motor in the casing 135 or body 205. The actuable barrier 250 may be actuated by fiber optic cable extending from the surface. The fiber optic cable may be provided within the walls of the casing 135 or body 205, and/or provided on the external surfaces or in the internal bore 210 of the body 205 and/or the internal bore of the casing 135.

Figure 3:
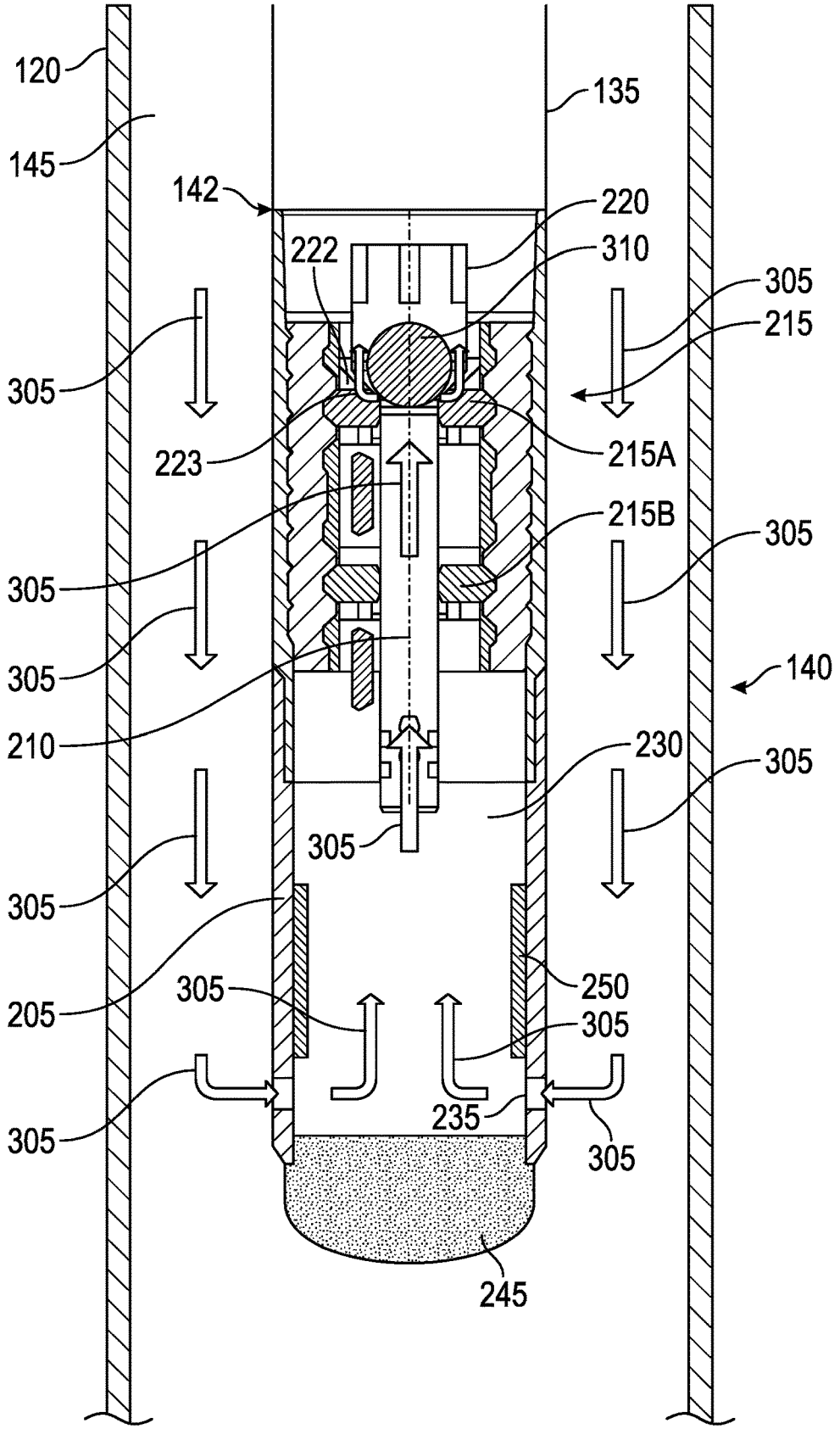
FIG. 3 illustrates a reverse cementing apparatus for a Circulation and Reverse Cementing operation according to the present disclosure.

The stinger 220 may have a shoulder surface 222 for receiving a dart (shown in FIG. 3). A dart may be dropped from the surface, and upon receipt by the shoulder surface 222 causes stinger 220 to be shifted downward against the shoulder surface 223 of an internal portion of the body 205 (shown in FIG. 3).

While a stinger is shown in FIG. 2, any mechanical object or projection may be employed. Moreover, in other embodiments, rather than a dart, a j-slot may be employed along the length of a stinger or other projection. Pressure pulses may be provided from the surface wherein the projection is rotated with each pressure surge to one or more positions until propping and maintaining the valve 215 in an open configuration.

FIG. 3 illustrates the reverse cementing apparatus 140 in the second circulation and reverse cementing stage. In this stage, a dart 310 has been dropped from the surface and received by the receiving surface 222 of the stinger 220, causing the stinger to transition in the downhole direction against the shoulder surface 223 to an actuated configuration. The stinger 220 blocks open the valve 215 and props and maintains it in an open configuration. Once the valve 215 has been actuated to the open configuration by the stinger 220, a fluid communication path is formed from the internal bore of the casing 120, the internal bore 210, the port 235, and the annulus 145. Initially, this open configuration allows downward circulation through the casing 135 and into the annulus 145 of wellbore 120 to condition the well.

After the well is conditioned, the "reverse" flow of a cementing slurry is conducted. As shown by the flow arrows 305, the cement slurry is pumped downhole through the annulus 145. The cement slurry then passes through the port 235 and then uphole through the chamber 230 and internal bore 210, and through and/or passed the stinger 220 as well as passed the dart 310, and to the casing 135.

Figure 4A:
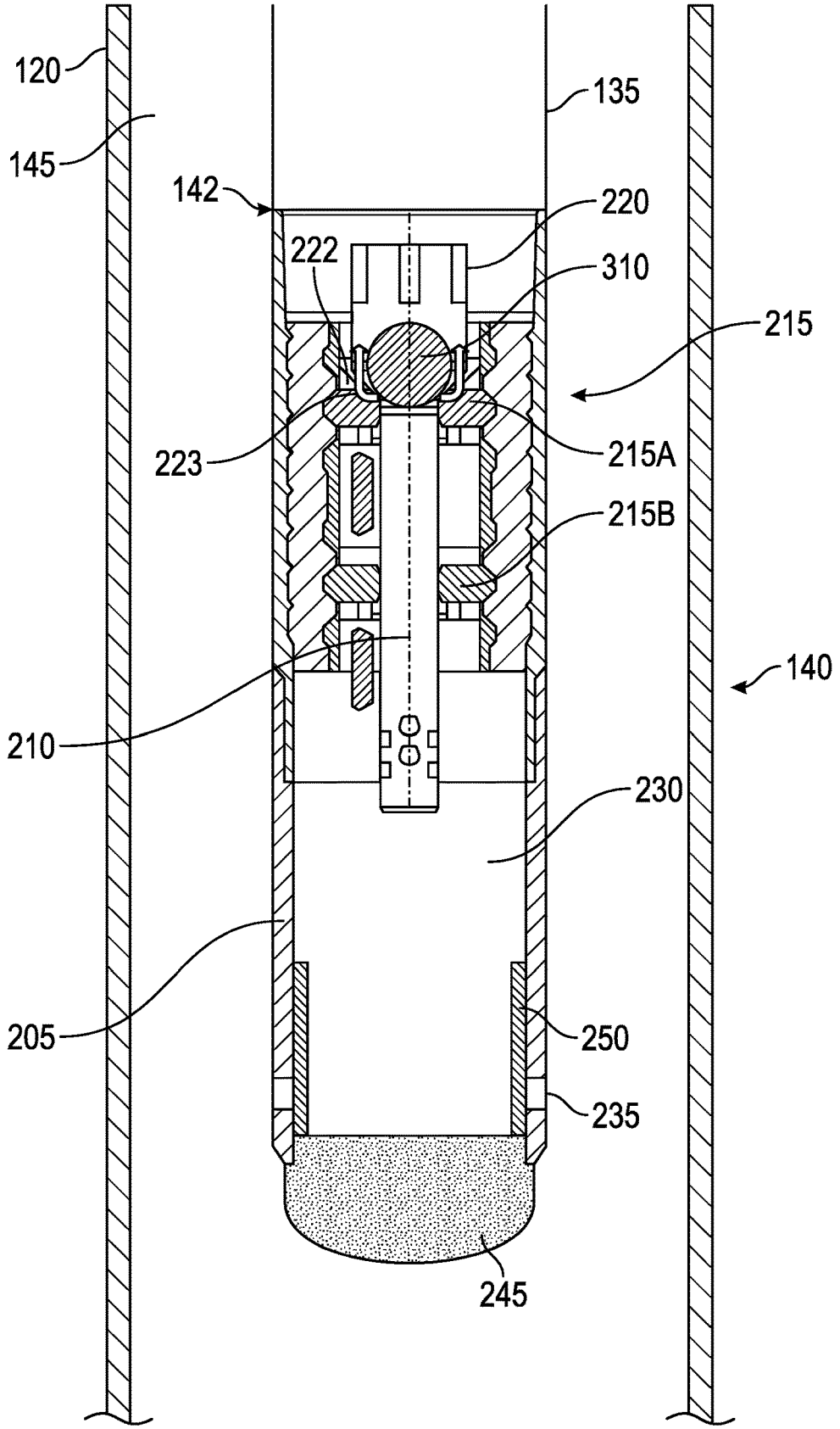
FIG. 4A illustrates a reverse cementing apparatus for an End-of-Job operation according to the present disclosure.

FIG. 4A illustrates the reverse cementing apparatus 140 in the third End-of-Job stage. When the reverse cementing stage is finished, the actuable barrier 250 is shifted downwardly into a closed configuration in which the port 235 is covered thereby obstructing and blocking the flow path from the annulus 145 to the internal bore 210 and the casing 120. While in the embodiment shown, the actuable barrier 250 is a sleeve which is shifted downwardly, in other embodiments it may be shifted in any direction, upwardly, or sideways, and may be a barrier other than a sleeve, such as plate, or arm, and may pivot rather than slide.

The actuable barrier 250 may be actuated by a wired connection which extends from the surface through the casing and reverse cementing apparatus 140. An electromechanical motor may be provide the motive force for moving the barrier. Additionally or alternatively, a battery may be employed for providing the power. Additionally, a fiber optic cable may be provided from the surface to actuate the barrier 250. The fiber optic cable may include conductive material to carrier electrical signal and/or an optical signal may be provided. Alternatively, the actuable barrier 250 may be actuated by pressure pulse or mud pulse.

Figure 4B:
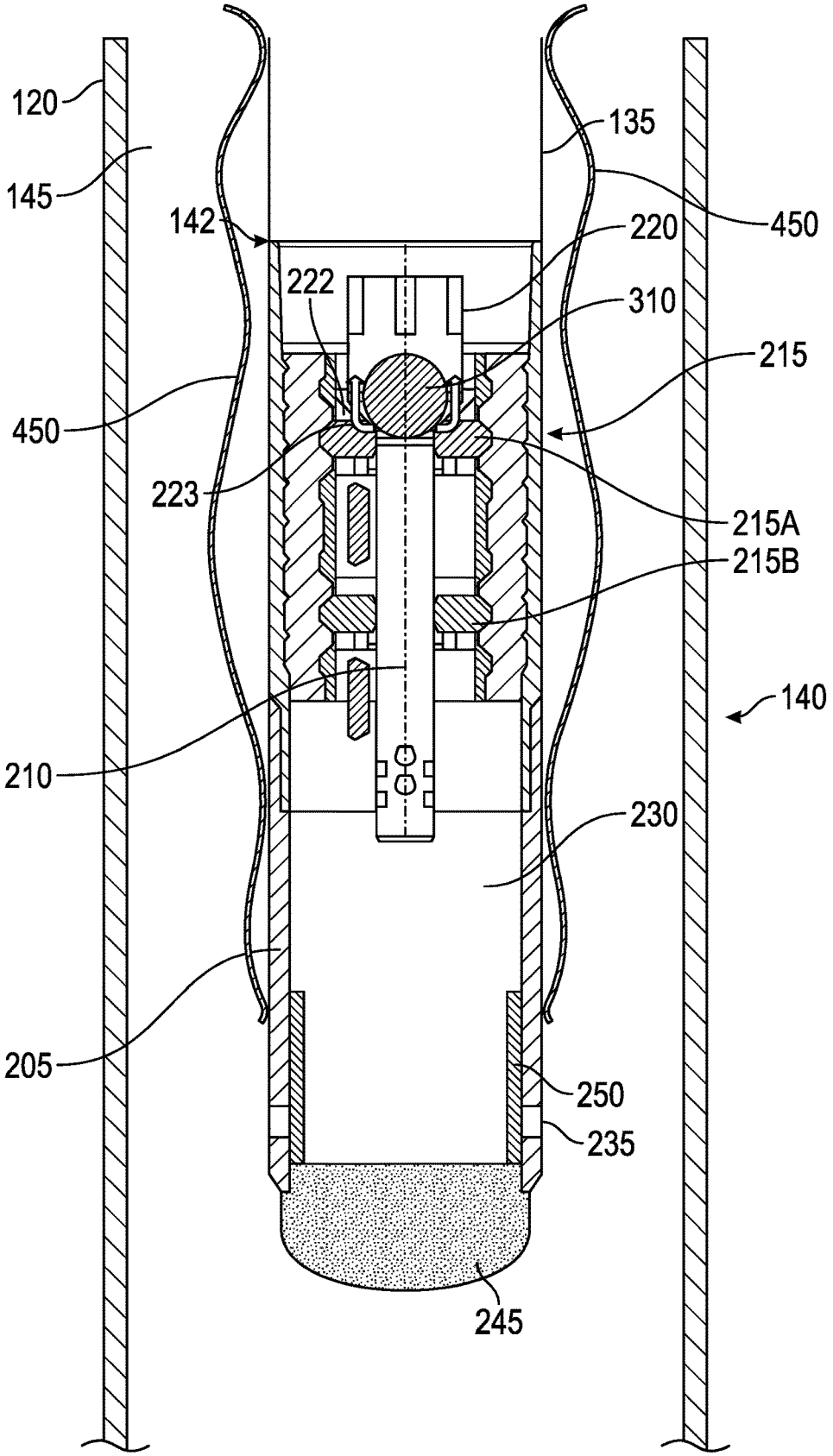
FIG. 4B illustrates a reverse cementing apparatus with a fiber optic cable for an End-of-Job operation according to the present disclosure.

FIG. 4B illustrates one embodiment of a reverse cementing apparatus 140 where the actuable barrier 250 is actuated by a fiber optic cable 450. The fiber optic cable may be attached to the external surface of the casing 135, and may carry electrical signal and/or an optical signal to the actuable barrier 250 and/or motor which moves the barrier 250.

The fiber optic cable 450 may additionally be employed as a distributed temperature system (DTS). The fiber optic cable 450 may be used to indicated temperature along the length of the wellbore 120 and annulus 145. The DTS may be employed to monitor and determine the status of the cementing job, and the placement of the cement in the annulus 145, as well as setting status. Accordingly, by monitoring the placement and status of the cement slurry during the reverse cementing process with the DTS, an operator may determine an appropriate time to conduct the end-of-job stage, at which time the barrier 250 may be closed via the fiber optic cable. The fiber optic sensing systems may operate using various sensing principles for determination of temperature including Raman scattering, Brillouin scattering, Coherent Rayleigh backscatter, and/or a combination of aforementioned with Enhanced or Engineered fibers. The fiber optic cables may house one or several optical fibers, and the optical fibers may be single mode fibers, multi-mode fibers or a combination of single mode and multi-mode optical fibers.

Figure 5:
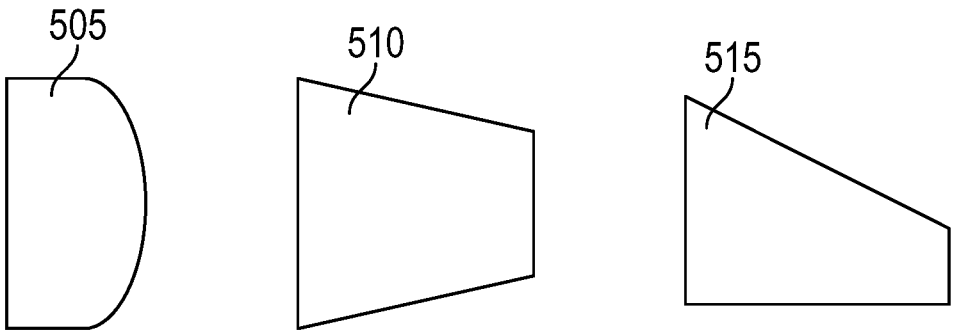
FIG. 5 illustrates examples of three different shapes of a drillable end nose, from left to right: round, tapered, and offset tapered according to the present disclosure.

FIG. 5 illustrates exemplary end noses for the reverse cementing apparatus 140. For instance the end nose 245 of FIGS. 3, 4A and 4B may have any shape including those provided in FIG. 5. The end noses of FIG. 5 illustrate the downhole direction on the right side of the figure. For instance, the end nose may have a rounded shape 505, or a tapered trapezoidal shape 510, or a half trapezoid such as shape 515. The end nose may have any polygonal shape, and may be shaped to facilitate entry through the wellbore during the Run-In-Hole stage. The end noses are made up of a drillable material so that at the end of the reverse cementing process, and hardening of the cement, it may be drilled out along with other components of the reverse cementing apparatus 140. The drillable material may include non-metal, non-iron metals, or may be aluminum or composite materials, or made of cement or a dissolvable material.

Figure 6:
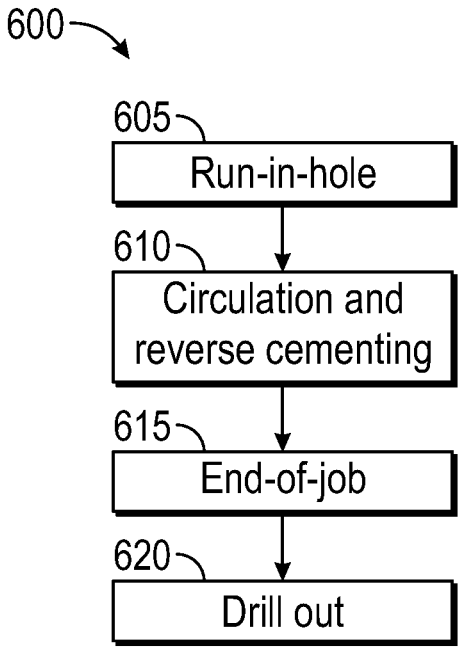
FIG. 6 is a schematic flow diagram of an exemplary process for a reverse cementing process employing the reverse cementing apparatus disclosed herein.

Exemplary Four Stages of Cementing Operations Employing the Reverse Cementing Apparatus FIG. 6 illustrates a flow diagram off our exemplary stages of the reverse cementing process 600 employing the reverse cementing apparatus disclosed herein. As shown is first RIH stage 605. During the first RIH stage 605 operation, the valve, which may be a double flapper valve, is in a closed configuration to provide well control during that phase of the job. However, in this configuration, fluid can be pumped down-hole, inside casing, from the surface, but upward flow is checked. A projection, such a stinger is provided that is retained above the flappers during RIH, but later, when deployed, push the valve, or the dual flappers, into an open configuration that permits upward fluid flow in the casing during the reverse cementing job.

Next the flow proceeds to a second Circulation and Reverse Cementing stage 610. In this stage, when the casing string reaches the targeted depth, a dart, such as a ball or plug can be dropped down and land on top of the projection, such as a stinger, and then shift the projection to prop open the valve, which may include two flappers. This opens a flow path from the surface, through the casing pipe, to the annulus. Initially, this allows downward circulation through the casing pipe and into the wellbore to condition the well. After the well is conditioned, the "reverse" flow of a cementing slurry is conducted down the annulus, into the casing pipe, through the ports in the reverse cementing valve. The flow of the cementing slurry enters the casing pipe through the ports, which are located below the sliding sleeve, and then up through the stinger into the casing internal bore.

Next the flow proceeds to a third End-of-Job stage 615. When the reverse cementing phase is finished, the barrier, which may be a sliding sleeve, is shifted downwardly into a closed configuration in which one or more ports are covered blocking and the flow path from the annulus to the casing ID. Finally, the flow proceeds to a fourth Drill Out stage 620. In this stage, the valve, which may be a double flapper valve, projection, which may be a stinger, and a dart, which may be a ball or plug, and end nose are drilled out to permit flow through the reverse cementing apparatus. Each of these components may be constructed from of drillable material (cement, aluminum, composite, etc.) to facilitate being drilled out after the cementing job is finished.

Statements of the disclosure include:

Statement 1. The method of statement 1 an apparatus comprising: a reverse cementing body having an internal bore, the reverse cementing body being coupleable to the downhole end of a casing pipe; a valve actuable from a closed to an open configuration, the closed configuration obstructing flow of fluid through the internal bore of the reverse cementing body, the valve configured to obstruct flow in an uphole direction during deployment but permit flow in the downhole direction; a port provided extending through a wall of the reverse cementing valve body from the internal bore to external the reverse cementing body, a fluid communication channel extending from the port to the internal bore; and an actuable barrier member actuable to a closed position obstructing flow of fluid through the port upon actuation.

Statement 2. The apparatus of statement 1, wherein the barrier member is a sliding sleeve, which upon actuation slides to obstruct flow of fluid through the port.

Statement 3. The apparatus of any one of the preceding claims 1-2, wherein the valve is a check valve, the check valve transitioning to a closed configuration to obstruct fluid flow in an uphole direction and transitioning to the open configuration to permit flow in a downhole direction until actuated to be maintained in an open configuration permitting flow in uphole and downhole directions.

Statement 4. The apparatus of any one of the preceding claims 1-3, further comprising a projection, wherein the valve is actuated from the closed to the open configuration by actuation of the projection to within the valve which blocks open the valve in the open configuration.

Statement 5. The apparatus of any one of the preceding claims 1-4, wherein the projection is a stinger.

Statement 6. The apparatus of any one of the preceding claims 1-5, wherein the valve is a flapper valve, the flapper valve transitioning to a closed configuration to obstruct fluid flow in an uphole direction and transitioning to the open configuration to permit flow in a downhole direction until actuated to be maintained in an open configuration permitting flow in uphole and downhole directions.

Statement 7. The apparatus of any one of the preceding claims 1-6, wherein the flapper valve is a dual flapper valve.

Statement 8. The apparatus of any one of the preceding claims 1-7, wherein the valve is actuated from the closed to the open configuration in response to a dart engaging a surface of the reverse cementing body.

Statement 9. The apparatus of any one of the preceding claims 1-8, further comprising a stinger positioned proximate the valve and transitional between a disengaged configuration away from flapper valve and an actuated configuration in which the stinger blocks open the flapper valve in the open configuration.

Statement 10. The apparatus of any one of the preceding claims 1-9, further comprising a fiber optic cable, the port actuable in response to a signal from the fiber optic cable.

Statement 11. The apparatus of any one of the preceding claims 1-10, wherein the fiber optic cable is part of a distributed temperature system.

Statement 12. A method comprising: deploying into a wellbore a reverse cementing body coupled with a casing, the reverse cementing body having an internal bore, a valve actuable from a closed to an open configuration, the closed configuration obstructing flow of fluid through the internal bore of the reverse cementing body, the valve configured to obstruct flow in an uphole direction during deployment; a port provided extending through a wall of the reverse cementing valve body from the internal bore to external the reverse cementing body, a fluid communication channel extending from the port to the internal bore, a barrier member actuatable to a closed position obstructing flow of fluid through the port upon actuation; pumping a fluid down inside the casing from the Earth's surface; actuating the valve to be maintained in the open configuration; passing a reverse cementing slurry from a casing annulus through one or more ports below the sliding sleeve and then through the internal bore to the casing; actuating the barrier to the closed position to obstruct flow of fluid through the port of the reverse cementing body.

Statement 13. The method of claim 12, wherein the valve is a flapper valve.

Statement 14. The method of any one of the preceding claims 12-13, drilling out the flapper valve, and an end nose of the reverse cementing body.

Statement 15. The method of any one of the preceding claims 12-14, wherein actuating the valve to be maintained in the open configuration comprises actuating a stinger positioned proximate the valve from a disengaged configuration away from the valve and an actuated configuration in which the stinger blocks open the valve in the open configuration.

Statement 16. The method of any one of the preceding claims 12,-15 wherein the barrier is a sliding sleeve.

Statement 17. The method of any one of the preceding claims 12-16, wherein the barrier is actuated via a signal transmitted in a fiber optic cable.

Statement 18. The method of any one of the preceding claims 12-17, wherein the fiber optic cable is employed as part of a distributed temperature system, and wherein the placement of the cement is monitored via the fiber optic DTS.

Statement 19. A system comprising, a casing deployed in the wellbore, a reverse cementing body coupled with an end of the casing in the wellbore, the the reverse cementing body having an internal bore, a valve actuable from a closed to an open configuration, the closed configuration obstructing flow of fluid through the internal bore of the reverse cementing body, the valve configured to obstruct flow in an uphole direction during deployment; a port provided extending through a wall of the reverse cementing valve body from the internal bore to external the reverse cementing body, a fluid communication channel extending from the port to the internal bore, a barrier member actuatable to a closed position obstructing flow of fluid through the port upon actuation.

Statement 20. The system of claim 19, wherein the valve is a flapper valve.

Statement 21. The system of any one of the preceding claims 19-20, wherein the barrier member is a sliding sleeve, which upon actuation slides to obstruct flow of fluid through the port.

What is claimed is:

1. An apparatus comprising:

a reverse cementing body having an internal bore, the reverse cementing body being coupleable to the downhole end of a casing pipe;

a valve actuable from a closed to an open configuration, the closed configuration obstructing flow of fluid through the internal bore of the reverse cementing body, the valve configured to obstruct flow in an uphole direction during deployment but permit flow in the downhole direction;

a port provided extending through a wall of the reverse cementing valve body from the internal bore to external the reverse cementing body, a fluid communication channel extending from the port to the internal bore; and an actuable barrier member actuable to a closed position obstructing flow of fluid through the port upon actuation.

2. The apparatus of claim 1, wherein the barrier member is a sliding sleeve, which upon actuation slides to obstruct flow of fluid through the port.

3. The apparatus of claim 1, wherein the valve is a check valve, the check valve transitioning to a closed configuration to obstruct fluid flow in an uphole direction and transitioning to the open configuration to permit flow in a downhole direction until actuated to be maintained in an open configuration permitting flow in uphole and downhole directions.

4. The apparatus of claim 3, further comprising a projection, wherein the valve is actuated from the closed to the open configuration by actuation of the projection to within the valve which blocks open the valve in the open configuration.

5. The apparatus of claim 3, wherein the projection is a stinger.

6. The apparatus of claim 1, wherein the valve is a flapper valve, the flapper valve transitioning to a closed configuration to obstruct fluid flow in an uphole direction and transitioning to the open configuration to permit flow in a downhole direction until actuated to be maintained in an open configuration permitting flow in uphole and downhole directions.

7. The apparatus of claim 6, wherein the flapper valve is a dual flapper valve.

8. The apparatus of claim 6, wherein the valve is actuated from the closed to the open configuration in response to a dart engaging a receiving surface of a stinger, which engages a surface of the reverse cementing body.

9. The apparatus of claim 6, further comprising a stinger positioned proximate the valve and transitional between a disengaged configuration away from flapper valve and an actuated configuration in which the stinger blocks open the flapper valve in the open configuration.

10. The apparatus of claim 1, further comprising a fiber optic cable, the port actuable in response to a signal from the fiber optic cable.

11. The apparatus of claim 10, wherein the fiber optic cable is part of a distributed temperature system.

12. A method comprising:

deploying into a wellbore a reverse cementing body coupled with a casing, the reverse cementing body having an internal bore, a valve actuable from a closed to an open configuration, the closed configuration obstructing flow of fluid through the internal bore of the reverse cementing body, the valve configured to obstruct flow in an uphole direction during deployment;

a port provided extending through a wall of the reverse cementing valve body from the internal bore to external the reverse cementing body, a fluid communication channel extending from the port to the internal bore, a barrier member actuatable to a closed position obstructing flow of fluid through the port upon actuation;

pumping a fluid down inside the casing from the Earth's surface;

actuating the valve to be maintained in the open configuration;

passing a reverse cementing slurry from a casing annulus through one or more ports below a sliding sleeve and then through the internal bore to the casing;

actuating the barrier member to the closed position to obstruct flow of fluid through the port of the reverse cementing body.

13. The method of claim 12, wherein the valve is a flapper valve.

14. The method of claim 12, drilling out a flapper valve, and an end nose of the reverse cementing body.

15. The method of claim 12, wherein actuating the valve to be maintained in the open configuration comprises actuating a stinger positioned proximate the valve from a disengaged configuration away from the valve and an actuated configuration in which the stinger blocks open the valve in the open configuration.

16. The method of claim 12, wherein the barrier member is a sliding sleeve.

17. The method of claim 12, wherein the barrier member is actuated via a signal transmitted in a fiber optic cable.

18. The method of claim 12, wherein the fiber optic cable is employed as part of a distributed temperature system, and wherein the placement of the cement is monitored via the fiber optic DTS.

19. A system comprising, a casing deployed in the wellbore, a reverse cementing body coupled with an end of the casing in the wellbore, the the reverse cementing body having an internal bore, a valve actuable from a closed to an open configuration, the closed configuration obstructing flow of fluid through the internal bore of the reverse cementing body, the valve configured to obstruct flow in an uphole direction during deployment;

a port provided extending through a wall of the reverse cementing valve body from the internal bore to external the reverse cementing body, a fluid communication channel extending from the port to the internal bore, a barrier member actuatable to a closed position obstructing flow of fluid through the port upon actuation.

20. The system of claim 19, wherein the valve is a flapper valve.

21. The system of claim 19, wherein the barrier member is a sliding sleeve, which upon actuation slides to obstruct flow of fluid through the port.

* * * * *